US009134636B2

(12) United States Patent
Taguchi et al.

(10) Patent No.: US 9,134,636 B2
(45) Date of Patent: Sep. 15, 2015

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Tetsuya Taguchi, Kanagawa (JP); Satoshi Yoshida, Kanagawa (JP); Shinya Nakashima, Kanagawa (JP); Shinya Sakamoto, Kanagawa (JP); Kosaku Yoshimura, Kanagawa (JP); Emi Miyata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 56 days.

(21) Appl. No.: 14/026,608

(22) Filed: Sep. 13, 2013

(65) Prior Publication Data

US 2014/0255839 A1 Sep. 11, 2014

(30) Foreign Application Priority Data

Mar. 8, 2013 (JP) ..... 2013-047298

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 15/08*** | (2006.01) |

(52) U.S. Cl.

CPC ..... *G03G 9/0821* (2013.01); *G03G 9/08755* (2013.01); *G03G 9/08782* (2013.01); *G03G 9/08795* (2013.01); *G03G 9/08797* (2013.01); *G03G 9/09708* (2013.01); *G03G 9/09733* (2013.01); *G03G 9/09783* (2013.01); *G03G 15/0865* (2013.01)

(58) Field of Classification Search

CPC ..... G03G 9/08755; G03G 9/08782; G03G 9/09733; G03G 9/0821

USPC ..... 430/109.4, 108.8, 108.4, 108.1, 111.4

See application file for complete search history.

(56) References Cited

U.S. PATENT DOCUMENTS

| | | | | |
|---|---|---|---|---|
| 2003/0108808 | A1* | 6/2003 | Inoue et al. | 430/108.8 |
| 2004/0023141 | A1* | 2/2004 | Shirai et al. | 430/109.3 |
| 2006/0222995 | A1* | 10/2006 | Moriyama et al. | 430/122 |
| 2007/0141498 | A1* | 6/2007 | Umehara | 430/108.21 |
| 2008/0166647 | A1* | 7/2008 | Mang et al. | 430/108.4 |
| 2009/0142110 | A1 | 6/2009 | Oya et al. | |
| 2010/0124715 | A1* | 5/2010 | Nakazawa et al. | 430/109.4 |

FOREIGN PATENT DOCUMENTS

| | | |
|---|---|---|
| JP | A-2008-152212 | 7/2008 |
| JP | A-2009-047854 | 3/2009 |
| JP | A-2009-139408 | 6/2009 |

* cited by examiner

*Primary Examiner* — Christopher Rodee
(74) *Attorney, Agent, or Firm* — Oliff PLC

(57) ABSTRACT

An electrostatic charge image developing toner includes a binder resin and a release agent, and when a peak temperature during a first temperature increase and a peak temperature during a second temperature increase, that are obtained by differential scanning calorimetry including performing the first temperature increase at 10° C./min after holding at 10° C., performing cooling at −10° C./min, performing a heat treatment for 24 hours at 50° C., and performing the second temperature increase at 10° C./min, are represented by Tt1 and $Tt2_{(50°\ C.)}$, respectively, the following Expression (1) is satisfied:

$$Tt1<Tt2_{(50°\ C.)}. \qquad \text{Expression (1):}$$

13 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-047298 filed Mar. 8, 2013.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including a binder resin and a release agent, in which when a peak temperature during a first temperature increase and a peak temperature during a second temperature increase, that are obtained by differential scanning calorimetry including performing the first temperature increase at 10° C./min after holding at 10° C., performing cooling at −10° C./min, performing a heat treatment for 24 hours at 50° C., and performing the second temperature increase at 10° C./min, are represented by Tt1 and $Tt2_{(50°\ C.)}$, respectively, the following Expression (1) is satisfied: Expression (1): $Tt1<Tt2_{(50°\ C.)}$.

BRIEF DESCRIPTION OF THE DRAWINGS

Exemplary embodiments of the present invention will be described in detail based on the following figures, wherein.

DETAILED DESCRIPTION

Figure 1:
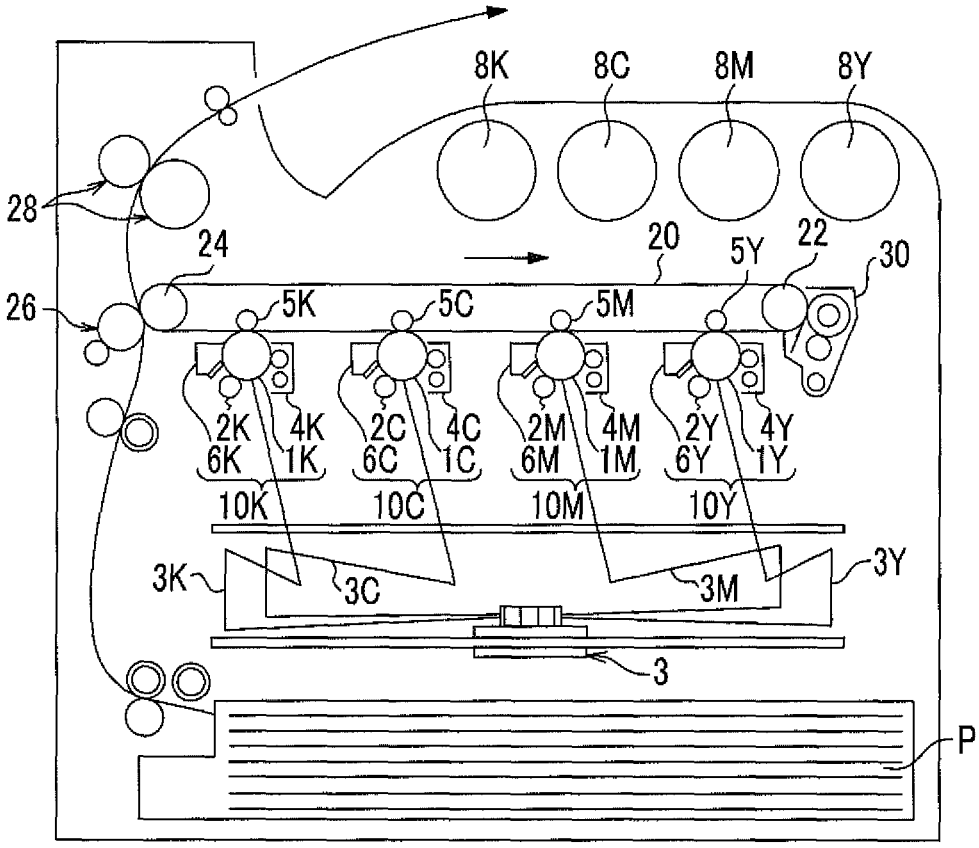
FIG. 1 is a schematic diagram showing a configuration of an image forming apparatus according to an exemplary embodiment.

Hereinafter, a toner according to an exemplary embodiment will be described in detail.

An electrostatic charge image developing toner according to this exemplary embodiment contains at least a binder resin and a release agent. When a peak temperature during a first temperature increase and a peak temperature during a second temperature increase, that are obtained by differential scanning calorimetry including the processes of: performing the first temperature increase at 10° C./min after holding at 10° C.; performing cooling to −10° C. at −10° C./min; performing a heat treatment for 24 hours at 50° C.; and performing the second temperature increase at 10° C./min, are represented by Tt1 and $Tt2_{(50°\ C.)}$, respectively, the following Expression (1) is satisfied.

$$Tt1<Tt2_{(50°\ C.)} \qquad \text{Expression (1)}$$

When a foreign object (such as a cap of a ballpoint pen, a knock part of a mechanical pencil, or a fingernail of a finger) is pressed against and rubbed over a toner image surface, the gloss of the toner image surface of the rubbed part changes and image quality may be reduced.

The reason for the change in the gloss of the toner image surface by rubbing is not always clear, but is presumed as follows. That is, it is thought that a binder resin of a toner image surface in a position which is pressed or rubbed is locally deformed and smoothness thus varies in comparison to an image surface of a surrounding part, whereby a change occurs in the gloss between the above position and another position.

The change in the gloss by rubbing is more remarkable in an image of secondary or higher color than in an image obtained with a single toner, and tends to more easily occur as the toner density of the image increases. Furthermore, this tends to be particularly remarkable in a toner having low-temperature fixability. In the case of an image of secondary or higher color or an image having a high toner density, a toner layer in the image is likely to become thick, and thus it is thought that a binder resin is easily locally deformed when being pressed or rubbed, so that smoothness varies in comparison to smoothness of an image surface of a surrounding part. In addition, a toner having low-temperature fixability has improved dissolubility with respect to heat, and has a characteristic in that it is thermally dissolved with less energy, and adhered and fixed to a recording medium. Therefore, a binder resin for use in the toner having low-temperature fixability has a low glass transition temperature and excellent sharp melt properties. It is thought that such a material is easily deformed by local heat or a local pressure that is generated by a pressure or rubbing by a foreign object even in an image after fixing, and as a result, it is presumed that a change in the gloss by rubbing easily occurs.

On the other hand, the toner according to this exemplary embodiment satisfies the above Expression (1). Here, in the above Expression (1), the peak temperature Tt1 is measured during the first temperature increasing process of the differential scanning calorimetry (DSC), and it is thought that this thermal characteristic behavior represents a thermal characteristic of the toner that has not received a high-temperature thermal history such as after a fixing process, that is, represents a glass transition temperature of the toner before fixing. In addition, the peak temperature $Tt2_{(50°\ C.)}$ is measured through the processes of: performing a first temperature increase; performing cooling; performing a heat treatment for 24 hours at 50° C.; and performing a second temperature increase in the differential scanning calorimetry (DSC). It is thought that the first temperature increasing process and the cooling process in this thermal characteristic behavior are regarded as a fixing process in the image formation, that is, the peak temperature $Tt2_{(50°\ C.)}$ is an index indicating a thermal characteristic of the toner after fixing. Furthermore, it is thought that the heat treatment for 24 hours at 50° C. with regard to the thermal characteristic behavior is regarded as thermal energy that is applied by itself with the lapse of time during the preservation of the fixed toner image, and it is thought that this thermal energy that is applied by itself is applied in a short time (24 hours). Accordingly, it is thought that the peak temperature $Tt2_{(50°\ C.)}$ is an index indicating a thermal characteristic of the toner immediately after fixing until a time has elapsed.

As described above, it is thought that the relation "$Tt1<Tt2_{(50°\ C.)}$" in Expression (1) is an index indicating that a glass transition temperature of the toner when a time has elapsed from preservation after fixing is higher than that of the toner before fixing.

Figure 3:
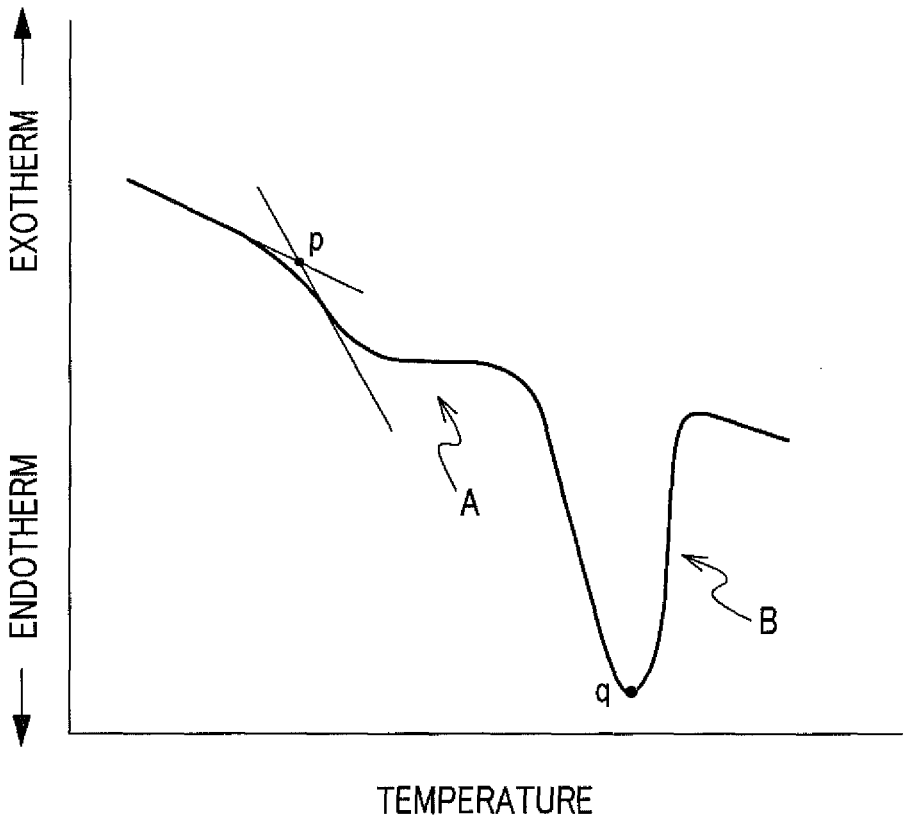
FIG. 3 is a graph showing a DSC curve for describing a peak temperature.

Here, the peak temperature represents an intersection point P between an endothermic peak and a rising gradient of a base line as shown in FIG. 3.

Regarding the toner according to this exemplary embodiment, as described above, a peak temperature of the toner immediately after fixing until a time has elapsed is higher than that of the toner before fixing. In the manufacturing of a toner, an amorphous resin and a crystalline resin are mixed with each other, and a toner is prepared in a state in which a part thereof is compatibilized. When fixing is performed, the amorphous resin and the crystalline resin are melted by heat and compatibilized more with the amorphous resin, and thus a melt viscosity is reduced and fixing on a recording medium such as paper is performed. After fixing, the temperature of the toner image is rapidly reduced on the recording medium and solidification occurs, whereby a toner image is obtained. The toner resin in a compatibilization state in the fixed image exhibits a low peak temperature in DSC, and image surface deformation by a pressure or rubbing easily occurs.

For example, by controlling the amorphous resin and the crystalline resin to have appropriate compatibility with each other in the preparation of the toner, when fixing is performed, the amorphous resin and the crystalline resin are melted by heat and compatibilized more with the amorphous resin, whereby a fixed image is obtained. However, after fixing, the amorphous resin and the crystalline resin in the fixed image are in an over-compatibilization state, and are thus phase-separated and crystallized.

That is, it is thought that the crystalline resin of the toner in the fixed image is easily recrystallized, and the crystalline resin and the amorphous resin are configured to be easily phase-separated. Therefore, after fixing, a peak temperature in DSC of the toner in the fixed image increases, and thermal and mechanical strength of the binder resin thus increases, and thus it is presumed that the binder resin is difficult to deform even when being pressed or rubbed, and a change in the gloss of the image surface by rubbing is suppressed.

Such an effect is also expressed in the case of using a wax compatible with an amorphous resin as well as a crystalline resin. In addition, recrystallization may be promoted by just adding, to the toner, a substance to be a nucleus of a crystal. It is preferable for the substance to be a nucleus of a crystal to have a crystal form similar to that of a crystalline resin or a wax to be used, or to have a high melting point. For example, a small amount of a crystalline resin or a wax having a higher melting point may be added, or resin particles, a crosslinking component in the resin, inorganic particles, or the like that have a high melting point may be used. Furthermore, recrystallization is promoted by appropriate heating and after an image is output using these toners, a tray that stores fixed images is heated at from 30° C. to 50° C. to add thermal energy to the fixed image after output, whereby a change in the gloss by rubbing in the fixed image may be more effectively suppressed.

When $Tt2_{(50° C.)}$ increases in comparison to Tt1, a reduction in image quality due to a change in the gloss by rubbing in the fixed image is suppressed, and fixing may be easily performed without the need to become highly sensitive from the viewpoint of handling and storage of the fixed image.

Difference between Tt1 and $Tt2_{(50° C.)}$

A difference between Tt1 and $Tt2_{(50° C.)}$ in Expression (1) is preferably from 1° C. to 30° C., and more preferably from 3° C. to 20° C. In addition, when a peak temperature during a second temperature increase, that is obtained by differential scanning calorimetry including the processes of: performing a first temperature increase at 10° C./min after holding at 10° C.; performing cooling to −10° C. at −10° C./min; performing a heat treatment for 24 hours at 40° C.; and performing the second temperature increase at 10° C./min is represented by $Tt2_{(40° C.)}$, $Tt2_{(40° C.)}$ is even more preferably from 3° C. to 20° C.

When the difference between Tt1 and $Tt2_{(50° C.)}$ is equal to or greater than the above lower limit value, the thermal and mechanical strength of the binder resin in the fixed image is more efficiently increased, and a change in the gloss by rubbing in the fixed image is more effectively suppressed. In addition, when $Tt2_{(40° C.)}$ is equal to or greater than the above lower limit, the mechanical strength is increased in a shorter time after fixing of the image, and thus a change in the gloss by rubbing in the fixed image is more effectively suppressed.

When $Tt2_{(40° C.)}$ is equal to or less than the above upper limit value, it is suppressed that over-recrystallization proceeds in the toner composition and transparency is thus reduced. When $Tt2_{(40° C.)}$ is greater than the above upper limit, a problem such as color dullness or a reduction in brightness occurs in the case in which, for example, a fixed image is formed on an OHP film and projected by a projector, or a fixed image is formed on an electric decoration film and shown by sheding light from one side. When Tt2 is equal to or lower than the upper limit, the occurrence of these problems is suppressed.

Achieving Method

The way to achieve a toner satisfying the above Expression (1) is not particularly limited, but a method using, for example, a material as a toner constituent material that is compatibilized during thermofusion and phase-separated during solidification is exemplified. Specific examples thereof include a method using a mixed material of a crystalline resin and a crystalline resin (e.g., saturated aliphatic polyesters having a large number of carbon atoms, and crystalline polyesters obtained by polymerizing 1,12-dodecanedicarboxylic acid that is a dicarboxylic acid having 12 carbon atoms with 1,12-dodecanediol that is a diol having 12 carbon atoms) having low compatibility with an amorphous resin, a method of controlling compatibility of an amorphous resin by adjusting an amount of an ethylene oxide (EO) adduct of bisphenol A in the amorphous resin, an amount of monomers to which a long alkyl chain is added, or the like, and a method of adding a nucleating agent (e.g., a paraffin wax having a high melting point, fatty acid metal salt, and metal oxide) as a recrystallization-promoting material.

However, in the toner according to this exemplary embodiment, it is particularly preferable to obtain low-temperature fixability and satisfy Expression (1) to balance low-temperature fixability and suppression of a change in the gloss by rubbing. From that viewpoint, it is preferable to employ a component configuration in which a compatibilization-promoting material and a phase separation-promoting material are used in combination and balanced. Specific examples of the compatibilization-promoting material include a crystalline resin (e.g., saturated aliphatic polyesters having an appropriate number of carbon atoms, saturated aliphatic polyesters obtained by polymerizing a sebacic acid that is a dicarboxylic acid having 8 carbon atoms with 1,10-decanediol that is a diol having 9 carbon atoms, and saturated aliphatic polyesters obtained by polymerizing a dodecanedioic acid that is a dicarboxylic acid having 10 carbon atoms with 1,6-hexanediol that is a diol having 6 carbon atoms) having high compatibility with an amorphous resin, ester wax, and a plasticizer that is melted at a fixing temperature.

That is, in this exemplary embodiment, it is preferable to have a configuration in which the compatibilization-promoting material and the phase separation-promoting material are mixed and balanced. This will be described later in detail.

Expression (2)

In addition, in this exemplary embodiment, when a peak temperature during a second temperature increase, that is obtained by differential scanning calorimetry that performs a first temperature increase at 10° C./min after holding at 10° C., cooling to −10° C. at −10° C./min, and the second temperature increase without performing a heat treatment, is represented by $Tt2_{(untreated)}$, it is preferable to satisfy the following Expression (2).

$$Tt2_{(untreated)} < Tt1 \quad \text{Expression (2)}$$

Here, the peak temperature $Tt2_{(untreated)}$ in the above Expression (2) is measured through the processes of: performing the first temperature increase; performing the cooling; and performing the second temperature increase without performing a heat treatment at 50° C. or 40° C. in the differential scanning calorimetry (DSC). It is thought that the first temperature increasing process and the cooling process in this thermal characteristic behavior are regarded as a fixing process in the image formation, that is, $Tt2_{(untreated)}$ is an index indicating a thermal characteristic of the toner upon fixing and melting.

In a toner in which the peak temperature $Tt2_{(untreated)}$ of the toner upon fixing is lower than the peak temperature Tt1 of the toner before fixing, obtained by DSC, low-temperature fixability is achieved.

The detailed reason for this is not clear, but it is thought that the fact that heating from the fixing member upon fixing causes a motion of molecules in the resin in the toner and the resin is thus compatibilized, and thus the melt viscosity of the resin is reduced and low-temperature fixability is exhibited is reflected in the thermal characteristic behavior of the toner upon fixing. That is, the reduction of $Tt2_{(untreated)}$ with respect to Tt1 is thought as a result of the mutual action by an interaction of branching of a molecular structure, a metal crosslinking, a plasticizing component, and the like. In order to obtain superior low-temperature fixability, the toner is preferably efficiently softened upon fixing. That is, it is preferable that $Tt2_{(untreated)}$ be lower than Tt1.

The difference between Tt1 and $Tt2_{(untreated)}$ shown in Expression (2) is preferably from 5° C. to 30° C., more preferably from 8° C. to 25° C., and even more preferably from 10° C. to 20° C.

When the difference between Tt1 and $Tt2_{(untreated)}$ is equal to or greater than the above lower limit value, more excellent low-temperature fixability is exhibited. On the other hand, when the difference between Tt1 and $Tt2_{(untreated)}$ is equal to or less than the above upper limit value, the performance of the toner before fixing is efficiently obtained.

The way to achieve a toner satisfying the above Expressions (1) and (2) is not particularly limited, but a toner satisfying the above Expressions (1) and (2) is favorably achieved by, for example, employing a configuration in which a compatibilization-promoting material is used and a phase separation-promoting material is mixed in a heated state and balanced therewith, as described above.

Tt1

The glass transition temperature (Tt1) during the first temperature increase is preferably from 40° C. to 60° C., more preferably from 45° C. to 60° C., and even more preferably from 50° C. to 60° C.

As described above, it is thought that Tt1 represents a glass transition temperature of the toner before fixing, and when this Tt1 is equal to or greater than the above lower limit value, superior charging maintainability, filming resistance, and blocking resistance are obtained. On the other hand, when Tt1 is equal to or less than the above upper limit value, more excellent low-temperature fixability is exhibited.

The way to achieve a toner satisfying the above Expression (1) and Tt1 in the above range is not particularly limited, but a toner satisfying the above Expression (1) and Tt1 in the above range is favorably achieved by, for example, employing a configuration in which a compatibilization-promoting material is used and a phase separation-promoting material is mixed and balanced therewith, or controlling a glass transition temperature of the amorphous resin, as described above.

Differential Scanning Calorimetry (DSC)

In this exemplary embodiment, the differential scanning calorimetry is performed by the following method.

DSC-60A (manufactured by Shimadzu Corporation) is used as a differential scanning calorimeter. In the measurement, as a first temperature increasing process, a temperature increase is performed from (10° C.) to 200° C. at a rate of 10° C./min after holding for 10 minutes at 10° C. A differential scanning calorimetry curve obtained at this time is analyzed based on JIS K-7121: 87 and the above-described peak temperature guiding method, and thus the peak temperature Tt1 is calculated.

Next, after the first temperature increasing process, holding is performed as is at 200° C. for 10 minutes, and then cooling to −10° C. is performed at a rate of −10° C./min using liquid nitrogen, and holding is performed at −10° C. for 10 minutes.

Thereafter, when the above-described $Tt2_{(50°\ C.)}$ is measured, a heat treatment is performed for 24 hours at 50° C. Any heater may be used as a heater for this heat treatment, as long as it may constantly maintain the temperature. For example, a constant-temperature chamber or the like is used. Thereafter, as a second temperature increasing process, a temperature increase is performed again from 10° C. to 200° C. at a rate of 10° C./min after holding for 10 minutes at 10° C. A differential scanning calorimetry curve obtained at this time is analyzed based on JIS K-7121:87 and the above-described peak temperature guiding method, and thus the peak temperature $Tt2_{(50°\ C.)}$ is calculated. The peak temperature $Tt2_{(40°\ C.)}$ is calculated in the same manner, except that the heat treatment is performed for 24 hours at 40° C.

In addition, when the peak temperature $Tt2_{(untreated)}$ is measured, the process proceeds up to the cooling process, and then without performing a heat treatment at 40° C. or 50° C., a temperature increase is performed again from −10° C. to 200° C. at a rate of 10° C./min as a second temperature increasing process. A differential scanning calorimetry curve obtained at this time is analyzed based on JIS K-7121:87 and the above-described peak temperature guiding method, and thus the peak temperature $Tt2_{(untreated)}$ is calculated.

The toner according to this exemplary embodiment is configured to include toner particles, and if necessary, an external additive.

Toner Particles

The toner particles are configured to include, for example, a binder resin, and if necessary, a colorant, a release agent, and other additives.

Binder Resin

Examples of the binder resin include vinyl resins formed of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used singly or in combination of two or more kinds thereof.

A polyester resin is suitable as the binder resin.

A known amorphous polyester resin is exemplified as the polyester resin. As the polyester resin, a crystalline polyester resin may be used in combination together with an amorphous polyester resin. However, the crystalline polyester resin may be used at a content of from 2% by weight to 40% by weight and preferably from 2% by weight to 20% by weight with respect to the total binder resin.

The "crystalline" resin indicates that the resin does not exhibit a stepwise change in endothermic quantity, but has a definite endothermic peak in the differential scanning calorimetry (DSC) of a single crystalline resin. Specifically, the "crystalline" resin indicates that the half-value width of the endothermic peak in the measurement at a rate of temperature increase of 10(° C./min) is within 10° C.

On the other hand, the "amorphous" resin indicates that the half-value width is greater than 10° C., a stepwise change in endothermic quantity is shown, or a definite endothermic peak is not recognized in the differential scanning calorimetry (DSC) of a single amorphous resin.

Amorphous Polyester Resin

Examples of the amorphous polyester resin include a condensation polymer of a polyvalent carboxylic acid and a polyol. A commercially available product or a synthesized product may be used as the amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexane dicarboxylic acid), aromatic dicarboxylic acids (e.g., terephthalic acid, isophthalic acid, phthalic acid, and naphthalene dicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As the polyvalent carboxylic acid, a tri- or higher-valent carboxylic acid having a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

As the polyol, a tri- or higher-valent polyol having a crosslinked structure or a branched structure may be used in combination together with diol. Examples of the tri- or higher-valent polyol include glycerin, trimethylolpropane, and pentaerythritol.

The polyols may be used singly or in combination of two or more kinds thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using HLC-8120 which is GPC manufactured by Tosoh Corporation as a measuring device, TSK gel Super HM-M (15 cm) which is a column manufactured by Tosoh Corporation, and a THF solvent. The weight average molecular weight and the number average molecular weight are calculated using a molecular weight calibration curve plotted from a monodisperse polystyrene standard sample from the results of the above measurement.

A known manufacturing method is used to manufacture the amorphous polyester resin. Specific examples thereof include a method of conducting a reaction at a polymerization temperature set to from 180° C. to 230° C., if necessary, under reduced pressure in the reaction system, while removing water or an alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the main component.

In this exemplary embodiment, from the viewpoint of satisfying the above Expression (1), it is preferable to use a phase separation-promoting material, and from the viewpoint of satisfying the above Expression (2) and the preferable range of Tt1, it is preferable to employ a configuration in which a compatibilization-promoting material is used and the phase separation-promoting material is mixed and balanced therewith.

Here, examples of the amorphous resin corresponding to the phase separation-promoting material include an amorphous resin having low compatibility. Examples thereof include amorphous polyesters to which the following raw material (incompatibilization raw material) that reduces compatibility is added as a raw material. Examples of the incompatibilization raw material include a propylene oxide adduct of bisphenol A, cyclohexanedimethanol, and alkenyl succinic acid.

Among these, control with the amount of a propylene oxide adduct of bisphenol A or alkenyl succinic acid is particularly preferable.

In the amorphous polyester that is used as an amorphous resin having low compatibility, as the composition ratio of the incompatibilization raw material, a propylene oxide adduct of bisphenol A is, for example, preferably from 1 to 99 (molar ratio), and more preferably from 2 to 10 with respect to 1 of an ethylene oxide adduct of bisphenol A.

In addition, examples of the amorphous resin corresponding to the compatibilization-promoting material include an amorphous resin having high compatibility. Examples thereof include amorphous polyesters to which the following raw material (compatibilization raw material) that improves compatibility is added as a raw material. Examples of the compatibilization raw material include a propylene oxide adduct of bisphenol A, fumaric acid, and ethylene glycol.

Among these, a propylene oxide adduct of bisphenol A is particularly preferable.

Crystalline Polyester Resin

Examples of the crystalline polyester resin include saturated, linear, aliphatic polyesters and polycondensates of linear polyvalent carboxylic acids and linear polyols. A commercially available product or a synthesized product may be used as the crystalline polyester resin.

Here, as the crystalline polyester resin, a polycondensate using a polymerizable monomer having a linear aliphatic group is preferably used rather than a polymerizable monomer having an aromatic group, in order to easily form a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, naphthalene-2,6-dicarboxylic acid, malonic acid, and mesaconic acid), anhydrides thereof, or lower alkyl esters (having, for example, from 1 to 5 carbon atoms) thereof.

As the polyvalent carboxylic acid, a tri- or higher-valent carboxylic acid having a crosslinked structure or a branched structure may be used in combination together with a dicarboxylic acid. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used singly or in combination of two or more kinds thereof.

Examples of the polyol include aliphatic diols (e.g., linear aliphatic diols having from 7 to 20 carbon atoms in a main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable as the aliphatic diol.

As the polyol, a tri- or higher-valent polyol having a crosslinked structure or a branched structure may be used in combination together with diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of the aliphatic diol may be 80 mol % or greater, and is preferably 90 mol % or greater.

The melting temperature of the crystalline polyester resin is preferably from 50° C. to 100° C., more preferably from 55° C. to 90° C., and even more preferably from 60° C. to 85° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The weight average molecular weight (Mw) of the crystalline polyester resin is preferably from 6,000 to 35,000.

For example, a known manufacturing method is used to manufacture the crystalline polyester resin as in the case of the amorphous polyester resin.

The content of the binder resin is, for example, preferably from 40% by weight to 95% by weight, more preferably from 50% by weight to 90% by weight, and even more preferably from 60% by weight to 85% by weight with respect to the entire toner particles.

In this exemplary embodiment, from the viewpoint of satisfying the above Expression (1), it is preferable to use a phase separation-promoting material, and from the viewpoint of satisfying the above Expression (2) and the preferable range of Tt1, it is preferable to employ a configuration in which a compatibilization-promoting material is used and the phase separation-promoting material is mixed and balanced therewith.

Here, examples of the crystalline resin corresponding to the phase separation-promoting material include a crystalline resin having low compatibility. Examples thereof include crystalline polyesters that use a linear aliphatic dicarboxylic acid having from 10 to 20 carbon atoms in a main chain part as the linear polyvalent carboxylic acid, and use a linear aliphatic diol having from 9 to 20 carbon atoms in a main chain part as the polyol.

Among these, particularly, the number of carbon atoms of the linear aliphatic dicarboxylic acid is more preferably from 10 to 18, and even more preferably from 12 to 16. In addition, the number of carbon atoms of the linear aliphatic diol is more preferably from 10 to 18, and even more preferably from 12 to 16.

In the crystalline resin having low compatibility, it is preferable not to use, as raw materials, an aliphatic dicarboxylic acid having 9 or less carbon atoms in a main chain part and an aliphatic diol having 9 or less carbon atoms in a main chain part.

In addition, examples of the crystalline resin corresponding to the compatibilization-promoting material include a crystalline resin having high compatibility. Examples thereof include crystalline polyesters that use a linear aliphatic dicarboxylic acid having from 2 to 10 carbon atoms in a main chain part as the polyvalent carboxylic acid, and use a linear aliphatic diol having from 2 to 10 carbon atoms in a main chain part as the polyol.

Among these, particularly, the number of carbon atoms of the linear aliphatic dicarboxylic acid is more preferably from 4 to 10, and even more preferably from 6 to 8. In addition, the number of carbon atoms of the linear aliphatic diol is more preferably from 4 to 10, and even more preferably from 6 to 8.

The ratio (B'/A') of the amount (B') of the crystalline resin having low compatibility to the amount (A') of the crystalline resin having high compatibility is preferably from 0.01 to 50, more preferably from 0.1 to 20, and even more preferably from 0.5 to 10.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, the colorant may be surface-treated or used in combination with a dispersant. Plural kinds of colorants may be used in combination.

The content of the colorant is, for example, preferably from 1% by weight to 30% by weight, and more preferably from 3% by weight to 15% by weight with respect to the entire toner particles.

Wax

Examples of the wax include hydrocarbon waxes; natural waxes such as carnauba wax, rice wax, and candelilla wax; synthetic or mineral/petroleum waxes such as montan wax; and ester waxes such as fatty acid esters and montanic acid esters.

In this exemplary embodiment, from the viewpoint of satisfying the above Expression (1), it is preferable to use a phase separation-promoting material, and from the viewpoint of satisfying the above Expression (2) and the preferable range of Tt1, it is preferable to employ a configuration in which a compatibilization-promoting material is used and the phase separation-promoting material is mixed and balanced therewith.

Paraffin waxes such as polyethylene wax and polypropylene wax are exemplified as phase separation-promoting wax, and ester waxes such as carnauba wax and rice wax and amide waxes are exemplified as compatibilization-promoting wax.

The melting temperature of the wax is preferably from 50° C. to 110° C., and more preferably from 60° C. to 100° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

In this exemplary embodiment, from the viewpoint of satisfying the above Expression (1), it is preferable to use a phase separation-promoting material, and from the viewpoint of satisfying the above Expression (2) and the preferable range of Tt1, it is preferable to employ a configuration in which a compatibilization-promoting material is used and the phase separation-promoting material is mixed and balanced therewith.

Here, examples of the additive corresponding to the compatibilization-promoting material include a liquid paraffin, a plasticizer that is melted at a fixing temperature, a block resin, a graft resin, and a fatty acid. Among these, a liquid paraffin is preferably used.

Specific examples of the plasticizer that is melted at a fixing temperature include a plasticizer having a melting temperature of from 50° C. to 100° C.

The amount of the plasticizer to be added, that is melted at a fixing temperature is preferably from 0.01 to 50, more preferably from 0.2 to 20, and even more preferably from 0.1 to 10 (mass ratio) with respect to the crystalline resin or wax.

In addition, examples of the additive corresponding to the phase separation-promoting material include an additive that has low compatibility, functions as a nucleating agent and promotes recrystallization of the crystalline resin.

Examples of the nucleating agent include paraffin waxes such as polyethylene wax and polypropylene wax, fatty acid metal salt, inorganic particles, and metal oxide particles.

The paraffin wax preferably has a linear alkyl chain, and the melting temperature thereof is preferably from 70° C. to 200° C., more preferably from 80° C. to 160° C., and even more preferably from 90° C. to 140° C.

The amount of the additive to be added is preferably from 0.01 to 20, more preferably from 0.1 to 15, and even more preferably from 1 to 10 (mass ratio) with respect to the crystalline wax or ester wax or amide wax.

Characteristics of Toner Particles

The toner particles may have a single-layer structure, or a so-called core-shell structure composed of a core (core particle) and a coating layer (shell layer) that is coated on the core.

Here, toner particles having a core-shell structure may be composed of, for example, a core configured to include a binder resin, and if necessary, other additives such as a colorant and a release agent and a coating layer configured to include a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersant. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter on the basis of particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained using the following expression.

$$SF1=(ML^2/A)\times(\pi/4)\times 100 \quad \text{Expression}$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and calculated as follows. That is, an optical microscopic image of particles applied to a surface of a glass slide is input to an image analyzer Luzex through a video camera to obtain maximum lengths and projected areas of 100 particles, values of SF1 are calculated using the above expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive may preferably be treated with a hydrophobizing agent. The treatment with a hydrophobizing agent is performed by, for example, dipping the inorganic particles in a hydrophobizing agent. The hydrophobizing agent is not particularly limited. Examples of the hydrophobizing agent include a silane coupling agent, silicone oil, a titanate coupling agent, and an aluminum coupling agent. These may be used singly or in combination of two or more kinds thereof.

The amount of the hydrophobizing agent is generally, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning activator (e.g., metal salt of higher fatty acid represented by zinc stearate, and fluorine-containing polymer particles).

The amount of the external additive to be externally added is, for example, preferably from 0.01% by weight to 5% by weight, and more preferably from 0.01% by weight to 2.0% by weight with respect to the toner particles.

Toner Manufacturing Method

Next, a method of manufacturing a toner according to this exemplary embodiment will be described.

The toner according to this exemplary embodiment is obtained by externally adding an external additive to toner particles after manufacturing of the toner particles.

The toner particles may be manufactured using any one of a dry manufacturing method (e.g., kneading and pulverization method) and a wet manufacturing method (e.g., aggregation and coalescence method, suspension and polymerization method, and dissolution and suspension method). The toner particle manufacturing method is not particularly limited to these manufacturing methods, and a known manufacturing method is employed.

Among these, the toner particles are preferably obtained by an aggregation and coalescence method.

In any manufacturing method, it is preferable that after an amorphous resin, a crystalline resin or wax, and other additives are mixed during the manufacturing, the temperature be equal to or higher than the glass transition temperature of the amorphous resin, and be then finally lower than the glass transition temperature of the amorphous resin. When the temperature is equal to or higher than the glass transition temperature of the amorphous resin after mixing of the toner composition, the amorphous resin and the crystalline resin or wax are partially compatibilized, and low-temperature fixability is improved. In addition, when the temperature is lower than the glass transition temperature of the amorphous resin, aggregation of the toner particles may be suppressed.

Specifically, for example, when the toner particles are manufactured by an aggregation and coalescence method, the toner particles are manufactured through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process and cooling).

Hereinafter, the respective processes will be described in detail.

In the following description, a method of obtaining toner particles containing a colorant and a release agent will be described. However, the colorant and the release agent are used if necessary. Additives other than the colorant and the release agent may be used.

Resin Particle Dispersion Preparation Process

First, for example, a colorant particle dispersion in which colorant particles are dispersed and a release agent dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium that is used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as sulfate-based, sulfonate-based, phosphate-based, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyol-based nonionic surfactants. Among these, anionic surfactants and cationic surfactants are particularly preferable. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, for example, a common dispersing method using, for example, a rotary shearing-type homogenizer, or a ball mill, a sand mill, or a Dyno mill having media are exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); converting the resin (so-called phase inversion) from W/O to O/W by adding an aqueous medium (W phase) to form a discontinuous phase, thereby dispersing the resin as particles in the aqueous medium.

The volume average particle diameter of the resin particles that are dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entire particles is measured as a volume average particle diameter D50p. The volume average particle diameter of the particles in other dispersions is also measured in the same manner.

The content of the resin particles that are contained in the resin particle dispersion is, for example, preferably from 5% by weight to 50% by weight, and more preferably from 10% by weight to 40% by weight.

For example, the colorant dispersion and the release agent dispersion are also prepared in the same manner as in the case of the resin particle dispersion. That is, the particles in the resin particle dispersion are the same as the colorant particles that are dispersed in the colorant dispersion and the release agent particles that are dispersed in the release agent dispersion, in terms of the volume average particle diameter of the particles in the resin particle dispersion, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion to form aggregated particles with a diameter near a target toner particle diameter that include the resin particles, the colorant particles, and the release agent particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated at a glass transition temperature of the resin particles (specifically, for example, from a temperature 30° C. lower than the glass transition temperature of the resin particles to a temperature 100° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity of the polarity of the surfactant that is used as the dispersant to be added to the mixed dispersion, such as inorganic metal salts and di- or higher-valent metal complexes. Particularly, when a metal complex is used as the aggregating agent, the amount of the surfactant to be used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the above processes.

After the aggregated particle dispersion in which the aggregated particles are dispersed is obtained, toner particles may be manufactured through the processes of: further mixing the resin particle dispersion in which the resin particles are dispersed with the aggregated particle dispersion to conduct aggregation so that the resin particles are further attached to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

Here, after the coalescence process ends, the toner particles formed in the solution are subjected to a washing process, a solid-liquid separation process, and a drying process, that are well known, and thus dry toner particles are obtained.

In the washing process, preferably displacement washing with ion exchange water may be sufficiently performed from the viewpoint of charging properties. In addition, the solid-liquid separation process is not particularly limited, but suction filtration, pressure filtration, or the like may be preferably performed from the viewpoint of productivity. Furthermore, the method for the drying process is also not particularly limited, but freeze drying, flash jet drying, fluidized drying, vibration-type fluidized drying, or the like may be preferably performed from the viewpoint of productivity.

The toner according to this exemplary embodiment is manufactured by, for example, adding an external additive to dry toner particles that have been obtained, and mixing them. The mixing may be performed with, for example, a V-blender, a Henschel mixer, a Loedige mixer, or the like. Furthermore, if necessary, coarse toner particles may be removed using a vibrating sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and the cores are coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluidized bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including: a charging process of charging a surface of an image holding member; an electrostatic charge image forming process of forming an electrostatic charge image on a charged surface of the image holding member; a developing process of developing the electrostatic charge image formed on the surface of the image holding member with the electrostatic charge image developer according to this exemplary embodiment to form a toner image; a transfer process of transferring the toner image formed on the surface of the image holding member onto a surface of a recording medium; and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image, a surface of an image holding member before charging; or an apparatus that is provided with an erasing unit that irradiates, after transfer of a toner image, a surface of an image holding member with erasing light before charging for charge erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawings will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration. Here, only the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll 2Y (an example of the charging unit) that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically attached to the latent image part having no electricity on the surface of the photoreceptor 1Y, whereby the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like, and as a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge and Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawings will be described, but descriptions of other parts will be omitted.

Figure 2:
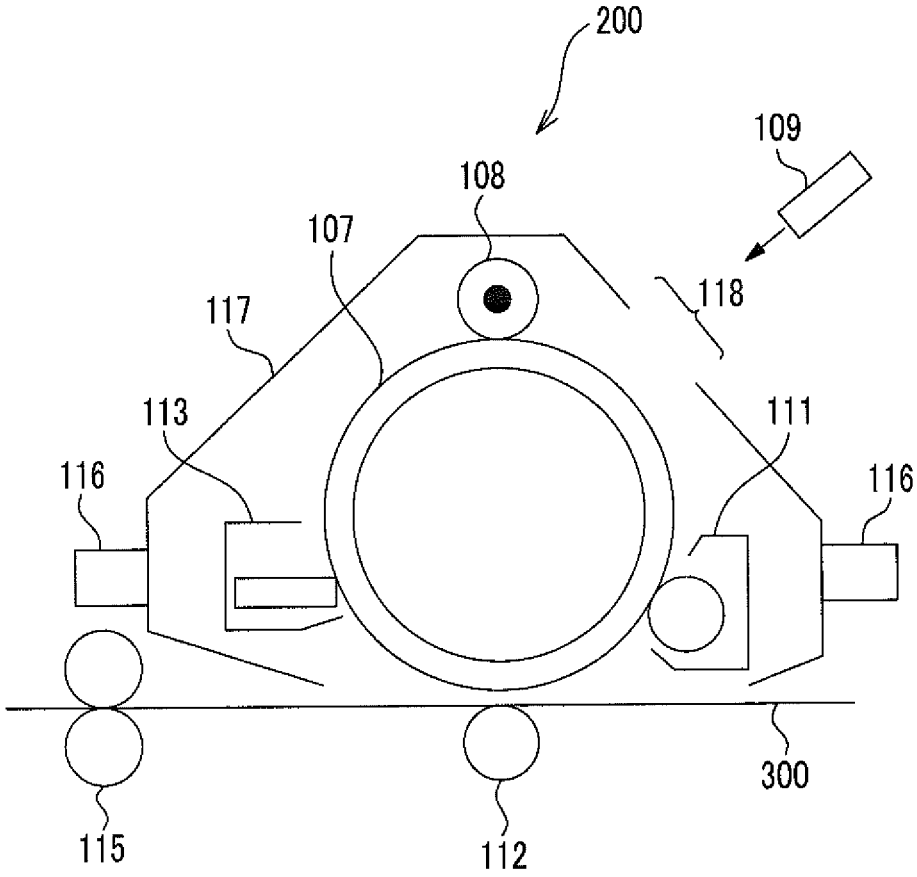
FIG. 2 is a schematic diagram showing a configuration of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by, for example, a casing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge that accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has a configuration from which the toner cartridges 8Y, 8M, 8C, and 8K are detachable, and the developing devices 4Y, 4M, 4C, and 4K are connected to the toner cartridges corresponding to the respective developing devices (colors) with toner supply tubes (not shown), respectively. In addition, when the toner accommodated in the toner cartridge runs low, the toner cartridge is replaced.

EXAMPLES

Hereinafter, this exemplary embodiment will be described in more detail using examples and comparative examples, but is not limited to these examples. Unless specifically noted, "parts" means "parts by weight".

Example 1

Preparation of Toner Particles (1)

Preparation of Crystalline Polyester Resin Particle Dispersion (1)

1,10-Decanedicarboxylic acid: 33 parts 1,4-Butanediol: 25 parts

Dimethyl Sulfoxide: 30 parts
Ethylene Glycol: 5 parts
Dibutyltin Oxide: 0.5 part The above composition is put into a dry, three-necked flask. Then, nitrogen gas is supplied by a pressure reducing operation so that the air in the container is under an inert atmosphere, and mechanical stirring is performed for 8 hours at 185° C. The dimethyl sulfoxide is distilled away under reduced pressure, and then the temperature is slowly increased to 210° C. under reduced pressure and stirring is performed for 2 hours. When the obtained material is viscous, it is air-cooled to stop the reaction, whereby a crystalline polyester resin (1) is synthesized.

170 parts of the crystalline polyester resin (1), 150 parts of ethyl acetate, and 0.05 part of a sodium hydroxide aqueous solution (0.5 N) are prepared, and these are put into a 500 ml separable flask, heated at 70° C., and stirred by a three-one motor (manufactured by Shinto Scientific Co., Ltd.), thereby preparing a crystalline resin mixture (1). While stirring this crystalline resin mixture (1), 500 parts of a sodium hydroxide aqueous solution (0.05 N) is slowly added to perform phase inversion emulsification. This phase inversion emulsion is transferred to a vat. While the phase inversion emulsion is stirred at an airy position, the solvent is removed by stirring for 48 hours, whereby a resin particle dispersion (1) in which crystalline polyester resin particles are dispersed is prepared.

Preparation of Amorphous Polyester Resin Particle Dispersion (1)

An acid component composed of 80 mol % of a terephthalic acid and 10 mol % of a fumaric acid, and an alcohol component composed of 45 mol % of an ethylene oxide 2 mol adduct of bisphenol A and 45 mol % of a propylene oxide 2 mol adduct of bisphenol A are charged, at a molar ratio of 1:1, into a flask with an inner capacity of 5 L that is provided with a stirrer, a nitrogen introduction pipe, a temperature sensor, and a rectifier, the temperature is increased to 80° C. over 2 hours under a nitrogen atmosphere, and it is confirmed that the stirring is uniformly performed in the reaction system. Thereafter, 0.5 part of dibutyltin oxide is added with respect to 100 parts of the mixture, and while distilling away water that has been generated, the temperature is increased from 80° C. to 210° C. over 2 hours to further continue the dehydration condensation reaction for 4 hours at 210° C., thereby obtaining an amorphous polyester resin (1).

Next, while being in a molten state, the obtained amorphous polyester resin (1) is transferred to a Cavitron CD1010 (manufactured by Eurotec, Ltd.) at a rate of 100 g/min. Diluted ammonia water having a concentration of 0.37% that is obtained by diluting reagent ammonia water with ion exchange water is put into a separately provided aqueous medium tank, and transferred to the Cavitron CD1010 (manufactured by Eurotec, Ltd.) simultaneously with the amorphous polyester resin melt at a rate of 0.1 L/min while being heated at 95° C. with a heat exchanger. The Cavitron is operated under conditions of a rotor rotation speed of 60 Hz and a pressure of 5 kg/cm$^2$ Thereafter, the pH in the system is adjusted to 8.5 with a 0.5 mol/l sodium hydroxide aqueous solution, and the treatment is performed for 5 hours at 45° C. Then, the pH is adjusted to 7.5 with a nitric acid aqueous solution, and the amount of the solid content is adjusted, thereby obtaining an amorphous polyester resin particle dispersion (1).

Preparation of Colorant Dispersion

Carbon Black (Mogul L: manufactured by Cabot Corporation): 55 parts
Nonionic Surfactant (Nonipol 400: manufactured by Sanyo Chemical Industries, Ltd.): 5 parts
Ion Exchange Water: 220 parts The above components are mixed and stirred for 10 minutes using a homogenizer (Ultra Turrax T50: manufactured by Ika-Werke Gmbh & Co. Kg.). Then, a dispersion treatment is performed by an ultimizer, thereby preparing a colorant dispersion in which colorant (carbon black) particles having an average particle diameter of 320 nm are dispersed.

Preparation of Release Agent Dispersion (1)

Paraffin Wax (HNP0190: manufactured by Nippon Seiro Co., Ltd., melting point: 85° C.): 100 parts
Cationic Surfactant (Sanisol B50: manufactured by Kao Corporation): 20 parts
Ion Exchange Water: 1500 parts The above components are dispersed for 10 minutes using a homogenizer (Ultra Turrax T50: manufactured by Ika-Werke Gmbh & Co. Kg.) in a round stainless-steel flask, and then subjected to a dispersion treatment using a pressure discharge-type homogenizer, thereby preparing a release agent dispersion (1) in which wax particles having an average particle diameter of 485 nm are dispersed.

Preparation of Toner Particles 1

A crystalline polyester resin particle dispersion (1) and an amorphous polyester resin particle dispersion (1) are mixed with each other at a solid content ratio of 15:70. 100 parts of this mixed resin particle dispersion, 10 parts of the colorant dispersion, 10 parts of the release agent dispersion (1), 5 parts of polyaluminum hydroxide (manufactured by Asada Chemical Industry Co., Ltd., Paho2S), and 600 parts of ion exchange water are mixed and dispersed using a homogenizer (Ultra Turrax T50: manufactured by Ika-Werke Gmbh & Co. Kg.) in a round stainless-steel flask, and then heated to 45° C. while stirring the inside of the flask in a heating oil bath. After holding for 30 minutes at 45° C., formation of aggregated particles having D50v of 6.3 μm is confirmed. Furthermore, the temperature of the heating oil bath is increased and holding is performed for 2 hours at 50° C. to increase D50v to 6.6 μm. Thereafter, 20 parts of an amorphous polyester resin particle dispersion (2) is added to the dispersion containing the aggregated particles, and then the temperature of the heating oil bath is increased to 60° C., and holding is performed for 30 minutes. A 1 N sodium hydroxide is added to the dispersion containing the aggregated particles to adjust the pH of the system to 8.2, and then the stainless-steel flask is sealed and heated to 75° C. while stirring is continuously performed using a magnetic seal. Then, holding is performed for 2 hours. After cooling with ice water, the toner particles are filtered and washed 5 times with ion exchange water at 25° C., and then freeze-dried, thereby obtaining toner particles 1.

Preparation of Carrier 2.5 parts of a styrene-acrylic resin (styrene:methyl methacrylate=10:90, Mw: 35,000) is put into 45 parts of toluene to prepare a resin solution. 0.2 part of carbon black is put into this resin solution, and this mixture is finely dispersed for 30 minutes using a sand mill, thereby preparing a dispersion. 25 parts of this dispersion is mixed with 100 parts of ferrite particles having a volume average particle diameter of 30 μm. This mixture is put into a vacuum deaeration-type kneader, stirred for 30 minutes while being heated at 80° C., and further stirred while the pressure is reduced, to remove the solvent. After removal of the solvent, sieving is performed with a 75 μm mesh to remove aggregates, thereby obtaining a carrier.

Examples 1 to 5, Comparative Examples 1 to 3

100 parts of toner particles 1, 0.5 part of an external additive (manufactured by Nippon Aerosil Co., Ltd., hydrophobic silica: RX50), and 1.5 parts of hydrophobic silica R972 manufactured by Nippon Aerosil Co., Ltd. are blended for 15 minutes at a peripheral velocity of 20 m/s using a Henschel mixer, and then coarse particles are removed using a sieve having a mesh opening size of 45 μm, thereby obtaining a toner. 10 parts of the obtained toner and 90 parts of a carrier are stirred for 20 minutes at 20 rpm using a V-blender, and sieved using a sieve having a mesh opening size of 212 μm, thereby obtaining a developer.

Evaluation Tests

Low-Temperature Fixability Test

Using a commercially available electrophotographic copier (modified DocuCentre Color 450 (manufactured by Fuji Xerox Co., Ltd.)), an unfixed image having a size of 3 cm×3 cm with a toner amount of 15 g/m$^2$ is output at a position that is below the upper end of OS coated paper W (basis weight: 127 g/m$^2$, manufactured by Fuji Xerox Co., Ltd.) by 3 cm.

Next, using a modified DocuCentre Color 450 that is modified so that a fuser unit used therein is taken out and external driving and temperature control are possible, the unfixed image is fixed under driving conditions of a fixing temperature of 140° C. and a fixing speed of 30 msec. The white paper part on the lower side of the fixed image is observed to confirm the occurrence of toner contamination (toner offset).

The fixed image part is slightly folded so that the image side is on the inner side. Then, a metal roll having a weight of 860 g and a diameter of 76 mm is allowed to be rolled and passes thereon at a rate of 150 mm/s to form a fold in the image part. The image is opened, and then an image deficiency state after slight rubbing over the image folding part by gauze is confirmed using a loupe of fifty magnifications.

Evaluation Standards

A: There is no contamination by toner offset, an image defect width after folding is less than 0.1 mm, and an excellent fixing state is obtained.

B: There is no contamination by toner offset, and an image defect width after folding is from 0.1 mm to less than 0.3 mm.

C: Very slight contamination by toner offset may be confirmed, or an image defect width after folding is from 0.3 mm to less than 0.6 mm.

D: Any one or both of a state in which contamination by toner offset may be obviously confirmed, and a state in which an image defect width after folding is 0.6 mm or greater. The fixing state is poor.

Toner Storability Test 10 g of a toner is weighed using a stainless-steel cup and left for 24 hours under an environment of 52° C. and 50% RH. Then, the movement of the toner is observed at the time of discharging the toner to 212 μm wire gauze by tilting the cup, and toner aggregates remaining on the gauze are observed by lightly shaking the 212 μm wire gauze to evaluate storability of the toner.

Evaluation Standards

A: When the cup is tilted, the toner flows smoothly, and no toner aggregates are present after shaking of the wire gauze.

B: When the cup is tilted, the toner flows smoothly, a small amount of toner aggregates is present after shaking of the wire gauze, and the aggregates easily disaggregate when being hit by a sharp object.

C: When the cup is tilted, the toner slowly disaggregates and flows, or toner aggregates are present after shaking of the wire gauze, and the aggregates easily disaggregate when being hit by a sharp object.

D: Any one or both of a state in which even when the cup is tilted, the toner does not flow, and when the cup have an impact thereon, the toner falls, and a state in which many toner aggregates are present after shaking of the wire gauze, and the aggregates do not easily disaggregate even when being hit by a sharp object.

Test for Change in Image Gloss by Rubbing

A bar having a 7 mm diameter metal ball at a tip end thereof is vertically pressed against a fixed image, that has been formed in the same manner as in the low-temperature fixability test, at a constant load, and rubbed thereover at a rate of 1 cm/sec, and the image after rubbing is observed.

Evaluation Standards

A: The gloss is nearly-unchanged even after rubbing at a load of 100 g.

B: The gloss is nearly-unchanged in the mark formed by rubbing at a load of 75 g, but in the mark formed by rubbing at a load of 100 g, a change in the gloss may be confirmed.

C: The gloss is nearly-unchanged in the mark formed by rubbing at a load of 50 g, but in the mark formed by rubbing at a load of 75 g, a change in the gloss may be confirmed.

D: A change in the gloss may be confirmed in the mark formed by rubbing a load of 50 g.

Example 2

Preparation of Crystalline Polyester Resin Mixture Dispersion (1)

Preparation of Crystalline Polyester Resin (2)

1,10-decanedicarboxylic acid: 33 parts 1,6-hexanediol: 29 parts

Dimethyl Sulfoxide: 30 parts

Dibutyltin Oxide: 0.5 part

A crystalline polyester resin (2) is obtained in the same manner as in the case of the crystalline polyester resin (1), except that the above composition is used.

Preparation of Crystalline Polyester Resin (3)

Terephthalic acid: 30 parts 1,10-decanediol: 30 parts

Dimethyl Sulfoxide: 30 parts

Dibutyltin Oxide: 0.5 part

A crystalline polyester resin (3) is obtained in the same manner as in the case of the crystalline polyester resin (1), except that the above composition is used.

A crystalline polyester resin mixture (1) is obtained by melting and mixing 95 parts of the crystalline polyester resin (2) and 5 parts of the crystalline polyester resin (3). A crystalline polyester resin mixture dispersion (1) is obtained in the same manner as in the case of the crystalline polyester resin dispersion (1), except that the crystalline polyester resin mixture (1) is used.

A toner is prepared by the method described in Example 1, except that the crystalline polyester resin dispersion (1) used in Example 1 is changed to the crystalline polyester resin mixture dispersion (1), and is subjected to the evaluation tests.

Example 3

Preparation of Release Agent Mixture Dispersion (1)

Preparation of Release Agent Mixture (1)

A release agent mixture (1) is obtained by melting and mixing 100 parts of pentaerythritol palmitate having a melting point of 72° C. and 2 parts of a polyethylene wax having a number average molecular weight of 900 and a melting point of 106° C.

A release agent mixture dispersion (1) is obtained in the same manner, except that the release agent mixture (1) is used in place of the release agent (1) in the release agent dispersion (1).

A toner is prepared by the method described in Example 1, except that the crystalline polyester resin dispersion (1) used in Example 1 is changed to the release agent mixture dispersion (1), and is subjected to the evaluation tests.

Example 4

Preparation of Amorphous Polyester Resin Particle Dispersion (2)

An acid component composed of 80 mol % of a terephthalic acid and 2 mol % of a trimellitic acid, and an alcohol component composed of 20 mol % of an ethylene oxide 2 mol adduct of bisphenol A and 62 mol % of a propylene oxide 2 mol adduct of bisphenol A are charged, at a mol ratio of 1:1, into a flask with an inner capacity of 5 L that is provided with a stirrer, a nitrogen introduction pipe, a temperature sensor, and a rectifier, the temperature is increased to 75° C. over 2 hours under a nitrogen atmosphere, and it is confirmed that the stirring is uniformly performed in the reaction system. Thereafter, 0.3 part of dibutyltin oxide is added with respect to 100 parts of the mixture, and while distilling away water that has been generated, the temperature is increased from 75° C. to 230° C. over 2 hours to further continue the dehydration condensation reaction for 5 hours at 230° C., thereby obtaining an amorphous polyester resin (2).

Next, while being in a molten state, the obtained amorphous polyester resin is transferred to a Cavitron CD1010 (manufactured by Eurotec, Ltd.) at a rate of 100 g/min. Diluted ammonia water having a concentration of 0.37% that is obtained by diluting reagent ammonia water with ion exchange water is put into a separately provided aqueous medium tank, and transferred to the Cavitron CD1010 (manufactured by Eurotec, Ltd.) simultaneously with the amorphous polyester resin melt at a rate of 0.1 L/min while being heated at 95° C. with a heat exchanger. The Cavitron is operated under conditions of a rotor rotation speed of 60 Hz and a pressure of 5 kg/cm$^2$. Thereafter, the pH in the system is adjusted to 8.5 with a 0.5 mol/l sodium hydroxide aqueous solution, and the treatment is performed for 5 hours at 45° C. Then, the pH is adjusted to 7.5 with a nitric acid aqueous solution, and the amount of the solid content is adjusted, thereby obtaining an amorphous polyester resin particle dispersion (2).

A toner is prepared by the method described in Example 1, except that the crystalline polyester resin particle dispersion (1), the amorphous polyester resin particle dispersion (1), and the amorphous polyester resin particle dispersion (2) are mixed at a solid content ratio of 15:35:35, and is subjected to the evaluation tests.

Example 5

A toner is prepared by the method described in Example 1, except that the crystalline polyester resin particle dispersion (1) and the amorphous polyester resin particle dispersion (1) are mixed at a solid content ratio of 30:55, and is subjected to the evaluation tests.

Comparative Example 1

A crystalline polyester resin particle dispersion (2) is obtained in the same manner, except that the crystalline polyester (1) is changed to the crystalline polyester resin (2) in the crystalline resin particle dispersion (1).

A toner is prepared by the method described in Example 1, except that the crystalline polyester resin particle dispersion (2) and the amorphous polyester resin particle dispersion (1) are mixed at a solid content ratio of 20:65, and is subjected to the evaluation tests.

Comparative Example 2

Preparation of Crystalline Polyester Resin (4)

Sebacic Acid: 40 parts
1,6-Hexanediol: 30 parts
Dimethyl Sulfoxide: 30 parts
Dibutyltin Oxide: 0.5 part A crystalline polyester resin (4) is obtained in the same manner as in the case of the crystalline polyester resin (1), except that the above composition is used.

A crystalline polyester resin dispersion (4) is obtained in the same manner as in the case of the crystalline polyester resin dispersion (1), except that the crystalline polyester resin (4) is used.

A toner is prepared by the method described in Example 1, except that the crystalline polyester resin particle dispersion (4) and the amorphous polyester resin particle dispersion (1) are mixed at a solid content ratio of 3:82, and is subjected to the evaluation tests.

Comparative Example 3

A toner is prepared by the method described in Example 1, except that the crystalline polyester resin particle dispersion (4) and the amorphous polyester resin particle dispersion (1) are mixed at a solid content ratio of 30:55, and is subjected to the evaluation tests.

TABLE 1

| | Tt1 [° C.] | $Tt2_{(50° C.)}$ [° C.] | $Tt2_{(40° C.)}$ [° C.] | $Tt2_{(untreated)}$ [° C.] | Low-Temperature Fixability | Toner Storability | Change in Image Gloss |
|---|---|---|---|---|---|---|---|
| Example 1 | 55 | 59 | 58 | 43 | A | A | A |
| Example 2 | 52 | 60 | 58 | 42 | A | A | A |
| Example 3 | 54 | 61 | 57 | 40 | A | A | A |
| Example 4 | 53 | 59 | 55 | 45 | B | A | B |
| Example 5 | 51 | 53 | 52 | 25 | A | B | B |
| Comparative Example 1 | 55 | 50 | 46 | 44 | A | A | D |
| Comparative Example 2 | 55 | 54 | 54 | 52 | D | A | C |
| Comparative Example 3 | 52 | 44 | 42 | 21 | A | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin;

a compatibilization-promoting material; and a release agent, wherein when a peak temperature during a first temperature increase and a peak temperature during a second temperature increase, that are obtained by differential scanning calorimetry including performing the first temperature increase at 10° C./min after holding at 10° C., performing cooling at −10° C./min, performing a heat treatment for 24 hours at 50° C., and performing the second temperature increase at 10° C./min, are represented by Tt1 and $Tt2_{(50° C.)}$, respectively, the following Expression (1) is satisfied:

$$Tt1 < Tt2_{(50° C.)}, \quad \text{Expression (1):}$$

wherein when a peak temperature during a second temperature increase, that is obtained by differential scanning calorimetry that performs a first temperature increase at 10° C./min after holding at 10° C., cooling at −10° C./min, and the second temperature increase at 10° C./min without performing a heat treatment, is represented by $Tt2_{(untreated)}$, the following Expression (2) is satisfied:

$$Tt2_{(untreated)} < Tt1, \text{ and} \quad \text{Expression (2):}$$

wherein the compatibilization-promoting material is a liquid paraffin.

2. The electrostatic charge image developing toner according to claim 1, wherein a difference between Tt1 and $Tt2_{(50° C.)}$ shown in the Expression (1) is from 1° C. to 30° C.

3. The electrostatic charge image developing toner according to claim 1, wherein a difference between $Tt2_{(untreated)}$ and Tt1 shown in the Expression (2) is from 5° C. to 30° C.

4. The electrostatic charge image developing toner according to claim 1, further comprising a phase separation-promoting material.

5. The electrostatic charge image developing toner according to claim 4, wherein the phase separation-promoting material contains at least any of a paraffin wax, fatty acid metal salt, and metal oxide particles.

6. The electrostatic charge image developing toner according to claim 5, wherein the paraffin wax has a melting temperature of from 70° C. to 200° C.

7. The electrostatic charge image developing toner according to claim 1, wherein the binder resin is a polyester resin.

8. The electrostatic charge image developing toner according to claim 1, wherein the binder resin contains a polyester resin having a glass transition temperature (Tg) of from 50° C. to 80° C.

9. The electrostatic charge image developing toner according to claim 1, wherein the binder resin contains a polyester resin having a weight average molecular weight (Mw) of from 5,000 to 1,000,000.

10. The electrostatic charge image developing toner according to claim 1, wherein the binder resin contains a polyester resin having a molecular weight distribution Mw/Mn of from 1.5 to 100.

11. The electrostatic charge image developing toner according to claim 1, wherein a volume average particle diameter is from 2 μm to 10 μm.

12. An electrostatic charge image developer comprising:

the electrostatic charge image developing toner according to claim 1.

13. A toner cartridge that contains the electrostatic charge image developing toner according to claim 1 and is detachable from an image forming apparatus.

* * * * *